US009510642B2

(12) United States Patent
Polegato Moretti

(10) Patent No.: US 9,510,642 B2
(45) Date of Patent: Dec. 6, 2016

(54) SHOE WITH WATERPROOF AND VAPOR-PERMEABLE UPPER AND SOLE

(75) Inventor: Mario Polegato Moretti, Crocetta Del Montello (IT)

(73) Assignee: GEOX S.p.A., Montebelluna, Localita Biadene (IT)

( * ) Notice: Subject to any disclaimer, the term of this patent is extended or adjusted under 35 U.S.C. 154(b) by 1006 days.

(21) Appl. No.: 13/575,052

(22) PCT Filed: Jan. 24, 2011

(86) PCT No.: PCT/EP2011/050921

§ 371 (c)(1),
(2), (4) Date: Jul. 25, 2012

(87) PCT Pub. No.: WO2011/098344

PCT Pub. Date: Aug. 18, 2011

(65) Prior Publication Data

US 2012/0297644 A1 Nov. 29, 2012

(30) Foreign Application Priority Data

Feb. 10, 2010 (IT) ..... PD2010A0037

(51) Int. Cl.
*A43B 1/02* (2006.01)
*A43B 7/08* (2006.01)
(Continued)

(52) U.S. Cl.
CPC ..... *A43B 7/125* (2013.01); *A43B 7/08* (2013.01); *A43B 9/02* (2013.01)

(58) Field of Classification Search
CPC ..... A43B 7/06; A43B 7/081; A43B 7/16; A43B 7/087
(Continued)

(56) References Cited

U.S. PATENT DOCUMENTS 7,823,297 B2 * 11/2010 Polegato Moretti ..... 36/3 R
2001/0049889 A1 * 12/2001 Chen ..... 36/55
(Continued)

FOREIGN PATENT DOCUMENTS

CN 1034480 A 8/1989
CN 1731942 A 2/2006
(Continued)

OTHER PUBLICATIONS

Combined Chinese Office Action and Search Report issued Apr. 21, 2014 in Patent Application No. 201180008821.4 (with English language translation).
(Continued)

*Primary Examiner* — Anna Kinsaul
*Assistant Examiner* — Timothy K Trieu
(74) *Attorney, Agent, or Firm* — Oblon, McClelland, Maier & Neustadt, L.L.P.

(57) ABSTRACT

A shoe with waterproof and vapor-permeable upper and sole, including: an upper assembly including, in a stratified manner, a vapor-permeable or perforated outer upper, a vapor-permeable inner lining, and, between them, a functional element; an insole including at least one waterproof vapor permeation region; and a bottom with a breathable sole. The functional element of the upper is firmly joined to the upper which ends toward the insole with a sealing band covered by an edge associated with a perimetric rim of the insole. The insole selectively includes or is joined to at least one lower functional element including at least one band which is free from the protective element. A mutual waterproof seal is provided between the functional element of the upper, at the sealing band, and the at least one lower functional element at the band.

20 Claims, 7 Drawing Sheets

(51) Int. Cl.

| | |
|---|---|
| ***A61F 5/14*** | (2006.01) |
| ***A43B 7/12*** | (2006.01) |
| ***A43B 9/02*** | (2006.01) |

(58) Field of Classification Search
USPC ..... 36/3 R, 147, 149, 84, 77, 77 M
See application file for complete search history.

(56) References Cited

U.S. PATENT DOCUMENTS

| | | | | |
|---|---|---|---|---|
| 2003/0041474 | A1 | 3/2003 | Keidel et al. | |
| 2006/0248751 | A1* | 11/2006 | Haimerl | 36/45 |
| 2008/0052956 | A1 | 3/2008 | Polegato Moretti | |
| 2008/0216358 | A1* | 9/2008 | Polegato Moretti | 36/3 A |
| 2009/0172971 | A1 | 7/2009 | Peikert et al. | |
| 2009/0211119 | A1* | 8/2009 | Moretti | 36/3 B |
| 2009/0300942 | A1 | 12/2009 | Peikert | |
| 2010/0050480 | A1 | 3/2010 | Moretti | |
| 2010/0064453 | A1 | 3/2010 | Haimerl | |
| 2013/0000149 | A1 | 1/2013 | Polegato Moretti | |
| 2014/0033452 | A1 | 2/2014 | Mueller | |

FOREIGN PATENT DOCUMENTS

| | | | |
|---|---|---|---|
| CN | 101421453 | A | 4/2009 |
| CN | 101677645 | A | 3/2010 |
| DE | 38 21 602 | | 3/1989 |
| DE | 103 00 012 | | 7/2004 |
| DE | 20 2007 000 668 | | 3/2007 |
| EP | 1 290 957 | | 3/2003 |
| JP | 2003-530178 | A | 10/2003 |
| JP | 2006-512132 | A | 4/2006 |
| JP | 2009-528104 | A | 8/2009 |
| JP | 2009-219786 | | 10/2009 |
| TW | 200812516 | A | 3/2008 |
| TW | 200913920 | A | 4/2009 |
| WO | WO 90/00969 | | 2/1990 |
| WO | WO 01/78542 | A1 | 10/2001 |
| WO | WO 2004/060094 | A1 | 7/2004 |
| WO | 2007 012415 | | 2/2007 |
| WO | WO 2007/101624 | A1 | 9/2007 |
| WO | 2008 116772 | | 10/2008 |

OTHER PUBLICATIONS

Office Action issued Feb. 3, 2015 in Japanese Patent Application No. 2012-552331 (with English translation).

Italian Search Report Issued Sep. 29, 2010 in IT PD20100037 Filed Feb. 10, 2010.

International Search Report Issued May 19, 2011 in PCT/EP11/050921 Filed Jan. 24, 2011.

Combined Taiwanese Office Action and Search Report issued May 27, 2015 in Patent Application No. 100104464 (with English language translation).

European Search Report issued in Application No. 11 701 251.8 on Jan. 12, 2016.

Japanese Office Action issued in Application No. 2012-552331 on Jan. 5, 2016 (w/ English translation).

* cited by examiner

SHOE WITH WATERPROOF AND VAPOR-PERMEABLE UPPER AND SOLE

TECHNICAL FIELD

The present invention relates to a shoe with waterproof and vapor-permeable upper and sole.

BACKGROUND ART

Currently, in the field of shoe manufacture, shoes are known which are provided with an upper assembly which comprises a membrane that is impermeable to water in the liquid state and permeable to water vapor.

Such shoes are generally appreciated because they combine the waterproofing provided by a waterproof sole with the waterproofing of the upper assembly, yet allowing vapor permeation of the foot through the upper assembly.

Membranes currently commonly used are made of expanded polytetrafluoroethylene, e-PTFE, or polyurethane, PU, and have an extremely limited tensile strength and therefore in order to protect their integrity substantially they cannot be shaped by elastoplastic deformation so as to adapt to the curves and cambers that the upper assembly has in order to adapt to the shape of the shoe.

In particular, at the rim of the upper assembly that is turned over so as to lie in the plantar region of the shoe in order to be joined to the insole, the upper assembly easily forms wrinkles and corrugations particularly at the more curved regions, for example at the heel and at the toe.

These wrinkles and corrugations, of the membrane as well, make difficult an effective grip on the membrane by material adapted to seal it to the sole, or optionally to a further membrane provided in the bottom of the shoe.

Nowadays, therefore, the need is strongly felt to devise increasingly simple and effective solutions for sealing the waterproof sole to the membrane of the upper assembly.

A solution currently devised consists in providing a band made of a net that is permeable to sealing material which is stitched to the upper, so as to replace its lower edge, and during use faces the edge of the inner lining that lines the upper internally, forming the upper assembly with said upper.

The waterproof membrane, which is gripped by sealing material that permeates the net band and also grips the sole or constitutes the material thereof by means of which the sole is formed by molding directly on the upper assembly stitched to the insole, is integrated in the multilayer inner lining.

U.S. Pat. No. 7,127,833 teaches to provide said band by using net which is substantially extensible, optionally elastically, in order to adapt to the curvature of the shape of the shoe in the joining regions between the insole and the upper assembly, where it connects the upper to the insole, and thus limit or avoid the formation of wrinkles and corrugations.

A drawback of a shoe provided according to the teaching of said patent consists in that water can penetrate through the upper and stagnates between said upper and the membrane integrated in the lining.

In order to avoid this drawback, patent WO2008119683 teaches to provide an upper that is joined directly to a membrane that is impermeable to water and permeable to water vapor.

However, the greater thickness of the materials generally used to provide the upper and their greater rigidity easily induce the formation of corrugations and wrinkles that are more substantial than those of the edge of the lining correspondingly in their region for joining to the insole.

This makes it even more difficult to solve the problem of achieving an effective grip to the membrane of sealing material that allows to obtain a shoe that is waterproof also at the connection of its upper assembly to its bottom.

Moreover, this problem is worsened when it is combined with the need to achieve an effective sealing of the membrane of the upper to a second membrane provided in the lower part of the shoe, therefore in the bottom or in the insole.

This second membrane, which is impermeable to water and permeable to water vapor, is adapted to close in a waterproof and vapor-permeable manner holes or openings provided through the bottom of the shoe in order to allow easy vapor permeation of the sole of the user's foot.

To make it also waterproof, a shoe that is vapor-permeable both at the sole and at the upper must have an effective waterproof seal between the membrane of the upper and the second membrane.

DISCLOSURE OF THE INVENTION

The aim of the present invention is to provide a shoe with waterproof upper and sole that overcomes the limitations of currently known shoes, allowing to have a structure that is simpler and allows to obtain an effectively waterproof shoe.

Within this aim, an object of the invention is to provide a shoe that avoids the stagnation of water inside its upper.

Another object of the invention is to provide a shoe which avoids the stagnation of water inside its upper so as to ensure that the user's foot remains warm and dry.

Another object of the invention is to provide a shoe which, by avoiding the stagnation of water in the upper, allows effective permeation of the water vapor from the foot insertion region toward the outside, further allowing to obtain a lightweight shoe.

Another object of the invention is to provide a shoe which, if wet, can dry easily and quickly.

An additional object of the invention is to provide a shoe that is easy to seal in a waterproof manner in order to prevent infiltrations of water inside it.

A further object of the invention is to provide a shoe that is effectively and durably waterproof while being vapor-permeable both through the upper assembly and through its bottom.

Another object of the invention is to provide a shoe that is structurally simple and is comfortable to wear and use.

This aim, as well as these and other objects that will become better apparent hereinafter, are achieved by a shoe with waterproof and vapor-permeable upper and sole, comprising

- an upper assembly which at least comprises, in a stratified manner, a vapor-permeable or perforated outer upper, a vapor-permeable inner lining, and, between them, a functional element of the upper which is permeable to water vapor and impermeable to water in the liquid state,
- an insole which is joined to said upper assembly and has at least one waterproof vapor permeation region,
- a bottom with a sole which has a vapor permeation region provided at said at least one waterproof vapor permeation region, in order to allow the dissipation of water vapor that arrives from said insole, said shoe being characterized in that said functional element of the upper is firmly joined to said upper substantially so as to adhere to it, said upper ending toward said insole with a sealing band, which is covered at least partly by the edge of said functional element of the upper, said sealing band and said edge being associated with a perimetric rim of said insole, said insole selectively comprising or being joined to at least one lower functional element which is permeable to water vapor and impermeable to water in the liquid state, said waterproof vapor permeation region being defined substantially, on said at least one lower functional element, by at least one vapor-permeable protective element, which is arranged so as to be interposed between said at least one lower functional element and said bottom with sole, said lower functional element having at least one band which is perimetric to said waterproof vapor permeation region, not covered by said protective element, a mutual waterproof seal being provided between said functional element of the upper, at said sealing band, and said at least one lower functional element at said band.

BRIEF DESCRIPTION OF THE DRAWINGS

Further characteristics and advantages of the invention will become better apparent from the description of preferred but not exclusive embodiments of the shoe according to the invention, illustrated by way of non-limiting example in the accompanying drawings, wherein.

Figure 1:
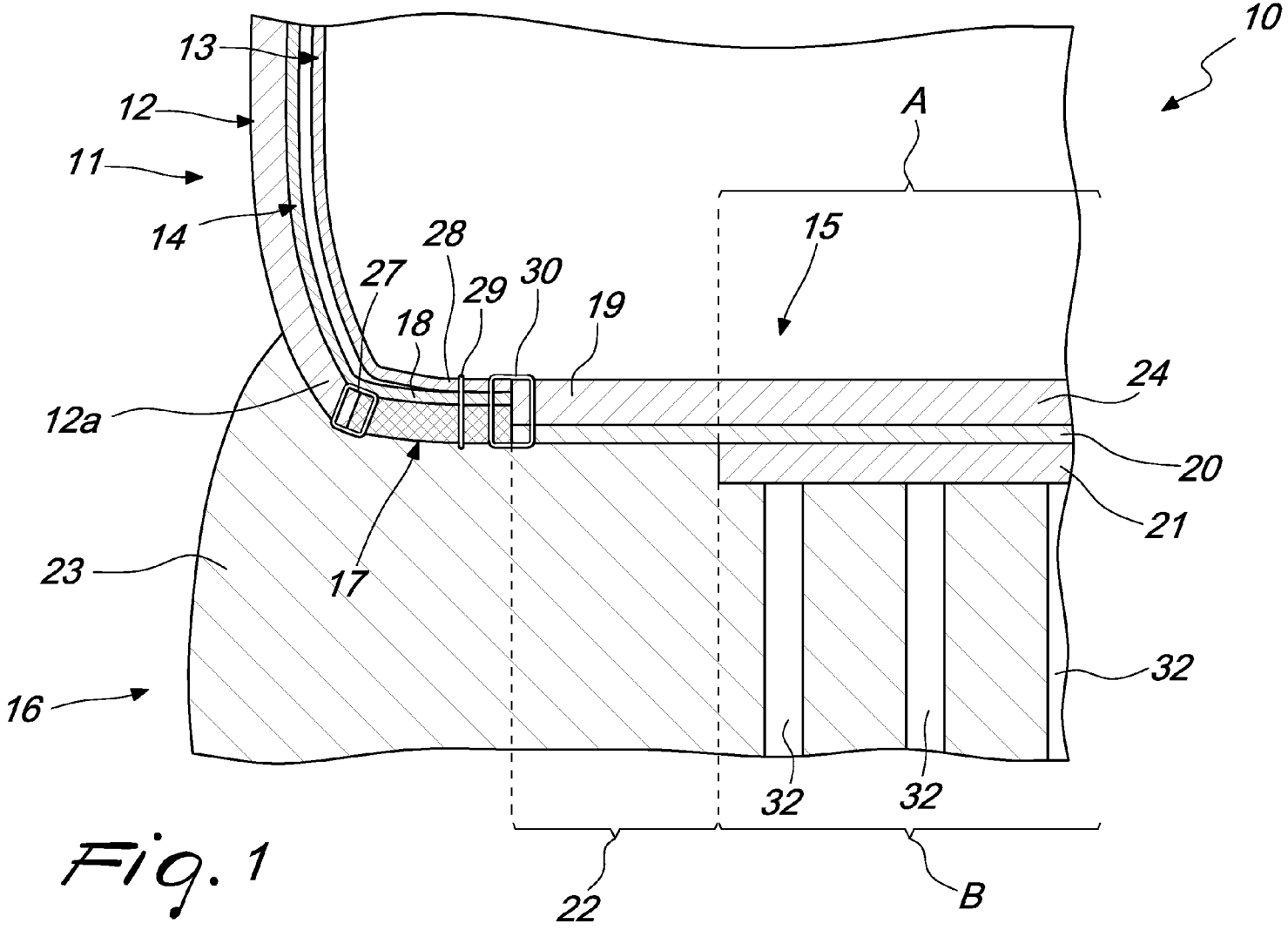
FIG. 1 is an enlarged-scale schematic sectional view of a detail of a shoe according to the invention.

It is noted that anything found to be already known during the patenting process is understood not to be claimed and to be the subject of a disclaimer.

WAYS OF CARRYING OUT THE INVENTION

With reference to the figures, the reference numeral 10 generally designates a shoe with waterproof and vapor-permeable upper and sole, comprising an upper assembly 11 which comprises, in a stratified manner, a vapor-permeable or perforated outer upper 12, a vapor-permeable inner lining 13, and, between them, a functional element of the upper 14 which is permeable to water vapor and impermeable to water in the liquid state, an insole 15 which is joined to the upper assembly 11 and has at least one waterproof vapor permeation region A, a bottom with a sole 16 which has a vapor permeation region B provided at the waterproof vapor permeation region A, in order to allow the dissipation of water vapor that arrives from the insole 15.

In alternative embodiments of the shoe 10, which are not described further or illustrated in the accompanying figures, there can be more than one of said vapor permeation regions and correspondingly more than one of said waterproof vapor permeation regions.

According to the invention, the shoe 10 has the peculiarity that the functional element of the upper 14 is firmly joined to the upper 12, substantially so as to adhere to it, said upper ending toward the insole 15 with a sealing band 17.

The sealing band 17 replaces part of the upper 12 and advantageously substantially replaces the edge of a body 12*a* thereof at its end for connection to the insole 15.

The sealing band 17 is covered by the edge 18 of the functional element of the upper 14, the sealing band 17 and the edge 18 being associated with a perimetric rim 19 of the insole 15, which selectively comprises or is joined to a lower functional element 20, which is permeable to water vapor and impermeable to water in the liquid state or, depending on the contingent requirements of embodiment of the invention, conveniently said insole comprises or is joined to at least one of said lower functional element.

Thus, in general, depending on the contingent requirements, said sealing band is conveniently covered at least partly by the edge of said functional element.

Advantageously, the functional element of the upper 14 is fully adherent with the upper 12, in particular with the body 12*a* of the upper 12 and with the sealing band 17, waterproofing them and waterproofing their joining region, which is preferably stitched.

The waterproof vapor permeation region A is substantially defined, on the lower functional element 20, by a vapor-permeable protective element 21, which is arranged so as to be interposed between the lower functional element 20 and the bottom with sole 16.

The lower functional element 20 has a band 22, which surrounds the waterproof vapor permeation region A not covered by the protective element 21.

Figure 4:
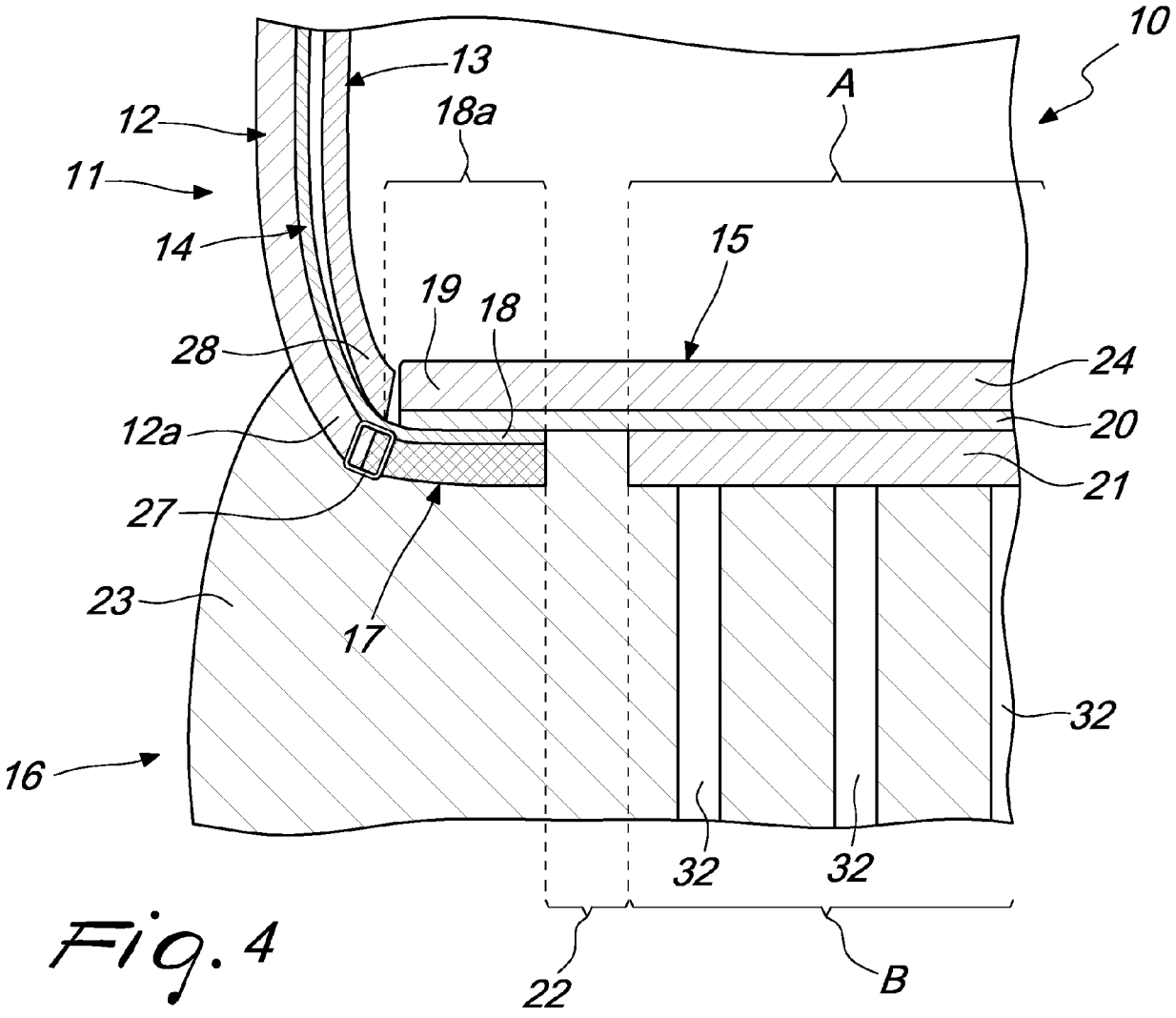
FIGS. 4, 5, 6 and 7 are enlarged-scale schematic sectional views of a detail of a shoe according to the invention in further alternative embodiments.
Figure 6:
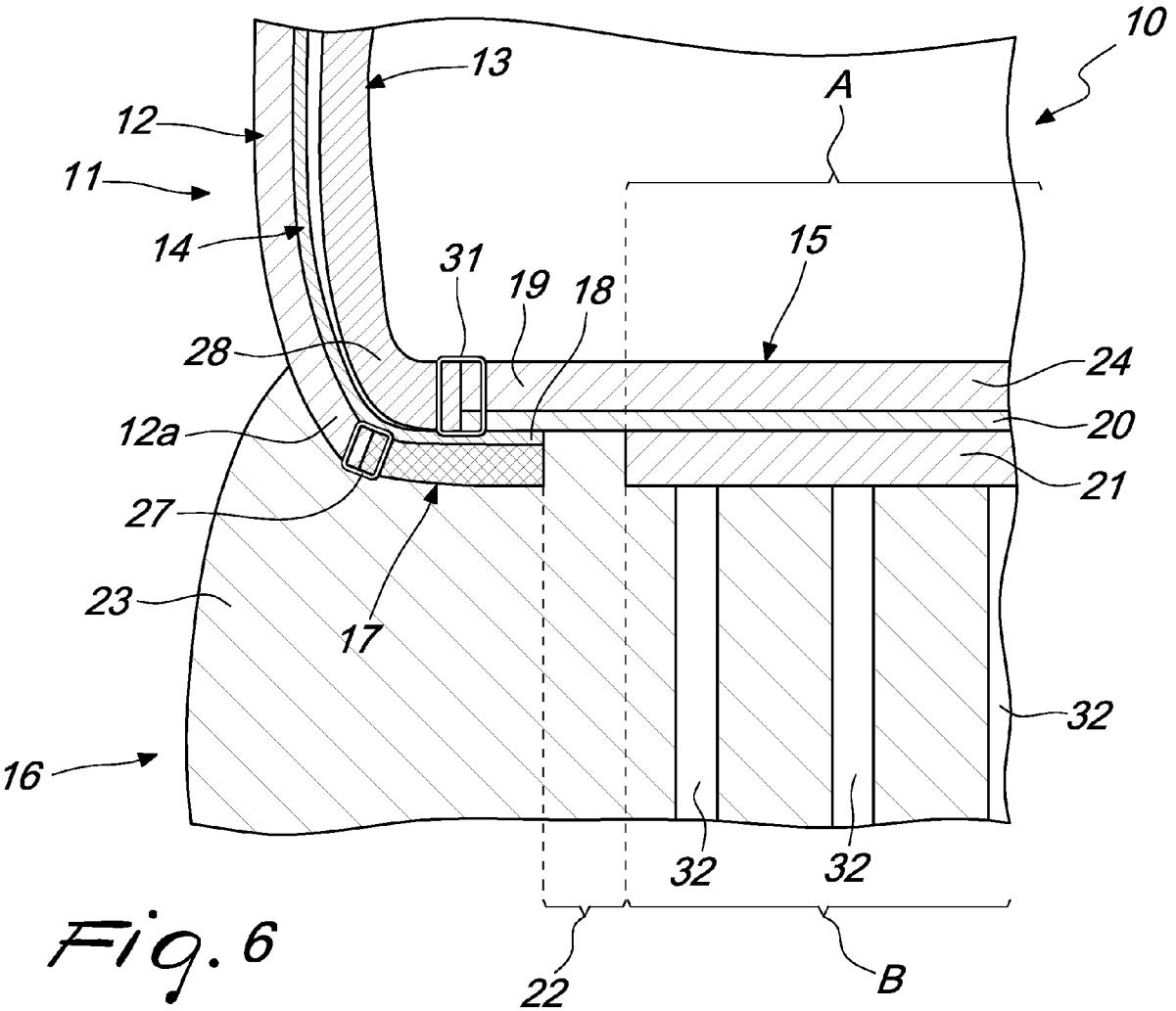

Moreover, there is sealing material 23 (which in the case of FIGS. 1, 4 and 6 is the material of the sole) which grips so as to form a waterproof seal the band 22 of the lower functional element 20 and cooperates with the sealing band 17 to provide a mutual waterproof seal between the edge 18 of the functional element of the upper 14 and the band 22 of the lower functional element 20.

Preferably, the face of the lower functional element 20 that is directed toward the bottom with sole 16 is covered by a supporting fine mesh, for example made of nylon, in a manner known per se which is not shown in the accompanying figures.

Depending on the contingent requirements, in alternative embodiments of the shoe said lower functional element conveniently can be provided with two supporting fine meshes that cover both of its faces.

Moreover, the insole 15 advantageously comprises at least one structural layer 24, which is vapor-permeable or perforated and is joined to the lower functional element 20, being directed toward the inside of the shoe 10 with respect to said element.

In some embodiments of a shoe according to the invention, such as for example those that provide for association by stitching the upper assembly to the insole, the structural layer 24 is conveniently made of soft material that can be stitched to the sealing band 17.

In other embodiments of a shoe according to the invention, such as for example those that provide for association of the upper assembly with the insole by way of the working method known as "AGO lasting", the structural layer 24 is instead preferably made of rigid material, capable of withstanding the stresses caused by the lasting operation.

In particular, the structural layer 24 is preferably made of a material selected among leather, felt, fabric, cellulose material and the like.

Depending on the contingent requirements, said insole, in alternative embodiments, can comprise, in diversified areas, a plurality of functional insole elements, a corresponding number of protective elements being provided which form on said functional insole elements waterproof vapor permeation regions that correspond to provided vapor permeation regions of said bottom with sole.

The insole 15 conveniently comprises at least one front portion 15*a*, which preferably corresponds substantially to the region of the forefoot and which, for at least one layer thereof, is defined by the lower functional element 20.

Advantageously, the insole 15 also comprises a rear portion 15*b* made of a material that is conveniently selected among felt, cellulose material, fabric or leather.

The portions 15*a* and 15*b* are joined preferably by gluing or zigzag stitching.

Advantageously, the band 22 is extended peripherally to the insole 15 and in particular is conveniently perimetric to its front portion 15*a*.

Moreover, the band 22 conveniently has a width substantially comprised between 5 mm and 6 mm.

In alternative embodiments of the invention, not shown in the accompanying figures, said lower functional element is extended along the entire plantar extension of said insole; in this case said perimetric band is peripheral to the entire insole, said waterproof vapor permeation region being extended predominantly in its plantar extension.

Advantageously, moreover, the functional element of the upper 14 and the lower functional element 20 are constituted by a membrane made of waterproof and vapor-permeable polymeric material selected conveniently among expanded polytetrafluoroethylene, e-PTFE, polyurethane, PU, and the like.

The functional element of the upper 14 is joined to the upper 12 preferably by flat hot pressing.

The joining of the upper 12 to the functional element of the upper 14 by flat hot pressing can be provided for example as follows.

The upper 12 is arranged on a plane, for example by leaving the two ends disconnected in the heel region 25 in order to allow its flat arrangement, and it assumes a substantially horseshoe-like shape.

The functional element of the upper 14 is joined to the upper 12 by means of said thermally activatable adhesive, which is distributed between them so as to not compromise their vapor permeability.

Thus, the coupling of the functional element of the upper 14 and of the upper 12 conveniently occurs by activation of said adhesive by heating to a temperature comprised substantially between 100° C. and 150° C., for a time selected in an interval comprised substantially between 5 seconds and 10 seconds, and simultaneous compression of the functional element of the upper 14 against the upper 12 at a pressure of approximately 6 bar.

Once the upper 12 has been joined to the functional element of the upper 14, in order to form the upper assembly 11 the corresponding ends of the heel 25, provided for this purpose, are joined by stitching and are mutually sealed for example by means of waterproof tape or waterproofing adhesive of the UPACO type, which are not shown in the accompanying figures.

In alternative manufacturing methods, in order to form said upper assembly it is possible to provide ends to be joined in different positions with respect to the heel, depending on the contingent requirements.

Conveniently, the functional element of the upper 14 covers internally and completely the upper 12.

However, if a shoe according to the invention that has a high quarter, such as boots or half-boots, is provided, the functional element of the upper 14 covers internally, preferably completely, the part of the shoe that surrounds the foot, substantially up to the instep.

In embodiments of said upper that provide for parts thereof that are already waterproof, said functional element of the upper instead might not be provided thereat, but a waterproof sealing joining of said waterproof parts with said functional element of the upper might be provided, for example by overlap and gluing of the respective rim portions for a band having a width comprised substantially between 5 mm and 10 mm, or said waterproof parts might be joined so as to provide a waterproof seal to said functional element of the upper by means of stitches sealed by superimposing waterproof adhesive tapes.

Advantageously, the upper assembly 11 is reinforced with a toe end, which is not shown in the accompanying figures.

Said toe end is joined to the upper 12, prior to association with the functional element of the upper 14, or to the lining 13.

Said toe end is conveniently pre-shaped, for example with a machine of the Leibrock VBF21Z vamp molding machine type, so as to minimize the formation of creases on the toe during the operation for associating the upper assembly 11 with the insole 15, which occurs subsequently.

Conveniently, the sealing band 17 is tape-shaped and has a width comprised substantially between 8 mm and 12 mm.

Advantageously, the sealing band 17 is elastically deformable and conveniently is deformed elastically during use.

In a first method of embodiment of the sealing band 17, it is advantageously permeable to sealing material.

In particular, in said first embodiment, the sealing band 17 is preferably made of a mesh of synthetic or natural fibers, knitted fabric, woven fabric or three-dimensional fabric, through which sealing materials or the polymeric material that composes the bottom with sole 16 can pass until it grips with a waterproof seal the functional element of the upper 14.

Advantageously, said sealing band 17 is made of monofilament synthetic material in order to avoid the wicking of water, being made for example of monofilament nylon.

Advantageously, in said first embodiment the sealing band 17 is elastically deformable in a differential manner along its two longitudinal sides 26*a* and 26*b*, which are joined respectively to the edge of the body 12*a* and to the rim 19.

In particular, a first longitudinal side 26*a* of the longitudinal sides 26*a* and 26*b* is conveniently stitched to the edge of the body 12*a* of the upper 12 and a second longitudinal side 26*b* of the longitudinal sides 26*a* and 26*b* is joined to the rim 19 of the insole 15 so as to compensate for the different arc length, subtended to the same angle, assumed correspondingly by the edge of the body 12*a* and by the rim 19 that the sealing band 17 joins.

The sealing band 17 conveniently comprises

- a central part, which has a structure selected among a structure with transverse fibers, a web-like structure, a knitted fabric structure, a woven fabric structure, a three-dimensional fabric structure, and
- two elastic bands, which are arranged laterally to said central part, with which they are monolithic, defining the longitudinal sides 26*a* and 26*b*.

In this manner, during the manufacturing of the shoe 10 the sealing band 17 is curved elastically according to the shape of the shoe 10 to be obtained by differential extension of the first longitudinal side 26*a* with respect to the second longitudinal side 26*b*, which in an extreme case is not extended.

The curved sealing band 17, thanks to the differential extension of the longitudinal sides 26*a* and 26*b*, thus conveniently allows to keep the edge of the body 12*a* of the upper 12 substantially flat, i.e., without wrinkles or corrugations, particularly in the regions of the toe and of the heel of the shoe 10, where the sealing band 17 has the greatest curvature, in order to facilitate the sealing, by means of the sealing band 17, of the functional element of the upper 14 to the lower functional element 20.

Moreover, it is thus possible to achieve an effective hermetic connection of the bottom with sole 16 to the upper assembly 11 joined to the insole 15.

Preferably, the sealing band 17 is provided by means of a band commercially known by the code 07/953 and is manufactured by the company NYHT.

In a second and alternative embodiment of the sealing band 17, which is substantially equivalent, said band is waterproof and made of waterproof polymeric material and adheres intimately, so as to provide a seal, to the lower edge 18.

In particular, the sealing band 17 is preferably made of thermo-activatable and waterproof thermo-adhesive material, such as a tape of thermoplastic hot-melt adhesive that is capable of melting and sealing to the functional element of the upper 14.

Advantageously, the sealing band 17 is connected to the edge of the body 12*a* of the upper 12 by means of a first seam 27.

The association of the sealing band 17 and of the edge 18 with the rim 19 of the insole 15, depending on the contingent requirements in the provision of a shoe 10, according to the invention, can be provided by means of methods that provide for the stitching or working method known as "AGO lasting", as described in greater detail hereinafter.

Thus, the joining of the bottom with sole 16 to the upper assembly 11 associated with the insole 15 also can be provided by gluing, according to the construction known as "cemented", or by molding, according to the construction known as "injected", depending on the contingent requirements in the provision of a shoe 10 according to the invention, as described more extensively hereinafter.

Figure 2:
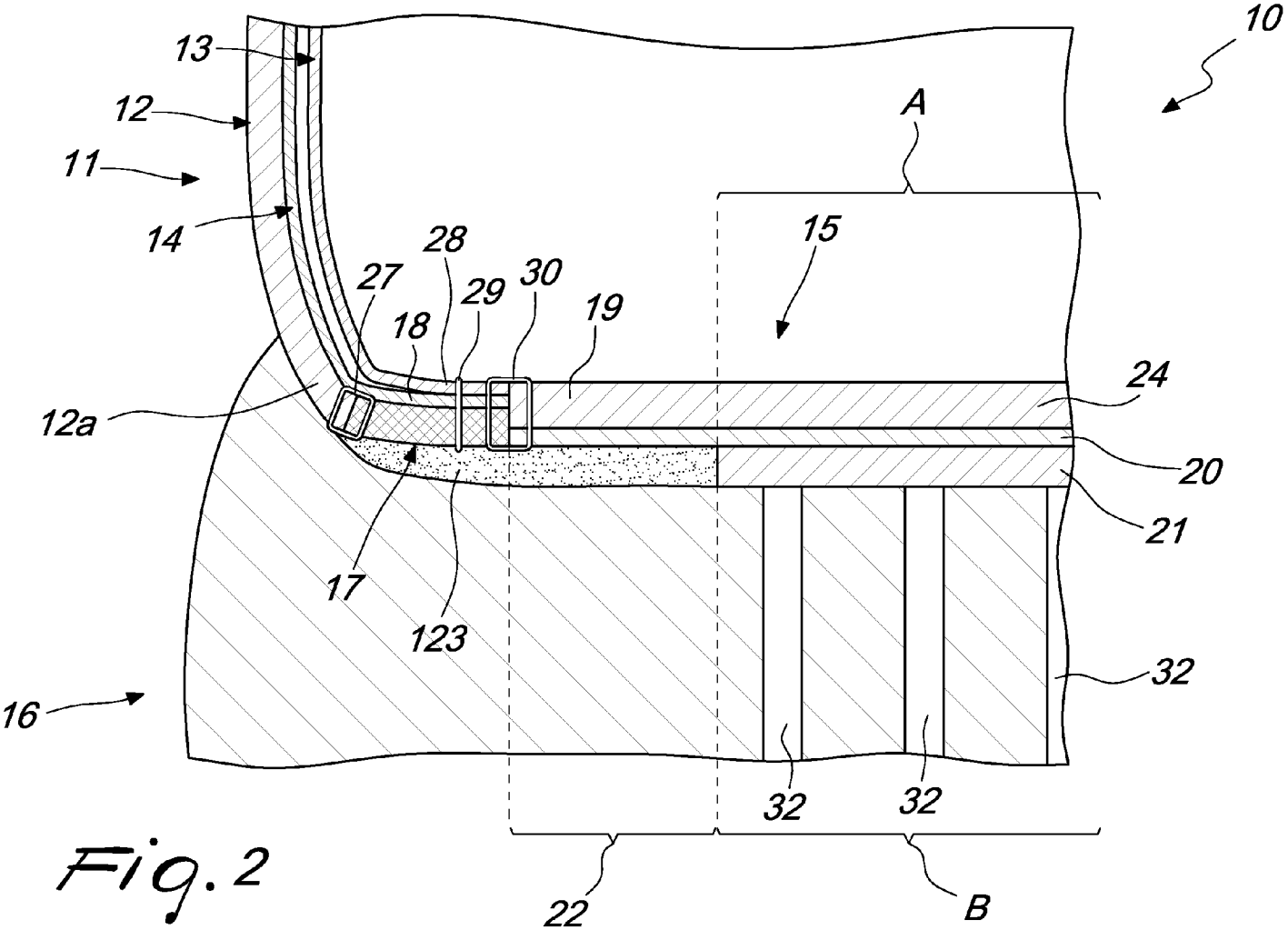
FIG. 2 is an enlarged-scale schematic sectional view of a detail of a shoe according to the invention in an alternative embodiment.
Figure 3:
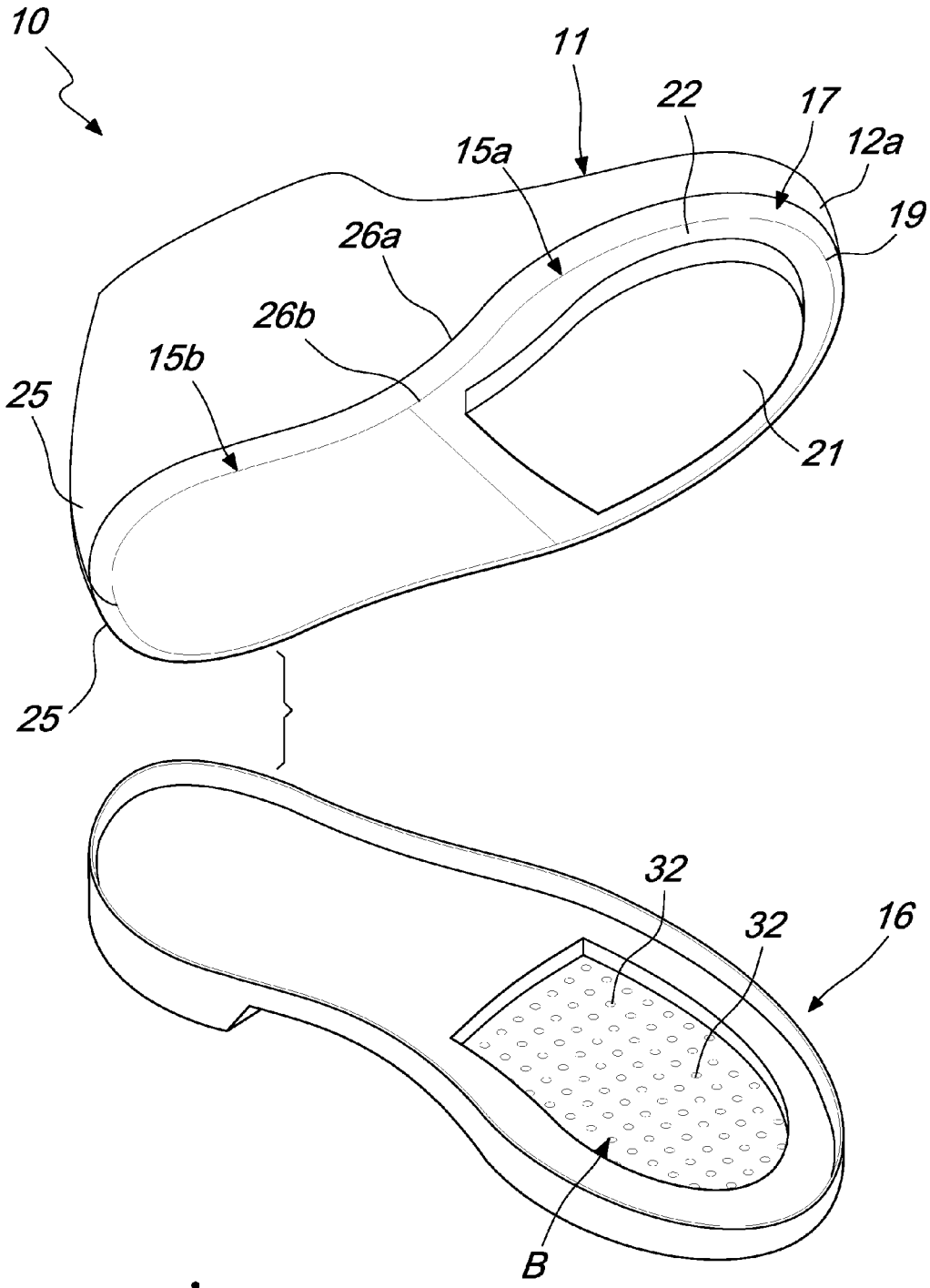
FIG. 3 is a partially exploded simplified schematic perspective view of a shoe according to the invention.

With particular reference to FIGS. 1 and 2, in a first method of embodiment of the invention the flap 28 of the lining 13 is joined, substantially coincident, to the edge 18 of the functional element of the upper 14 preferably by means of a second seam 29 of the type commonly known as "pinching sewing".

Moreover, the flap 28, the edge 18 and the sealing band 17 are joined to the rim 19 of the insole 15 preferably by means of a third seam 30, conveniently of the Strobel type or, in a substantially equivalent manner, of the type known as "pinching sewing".

Figure 5:
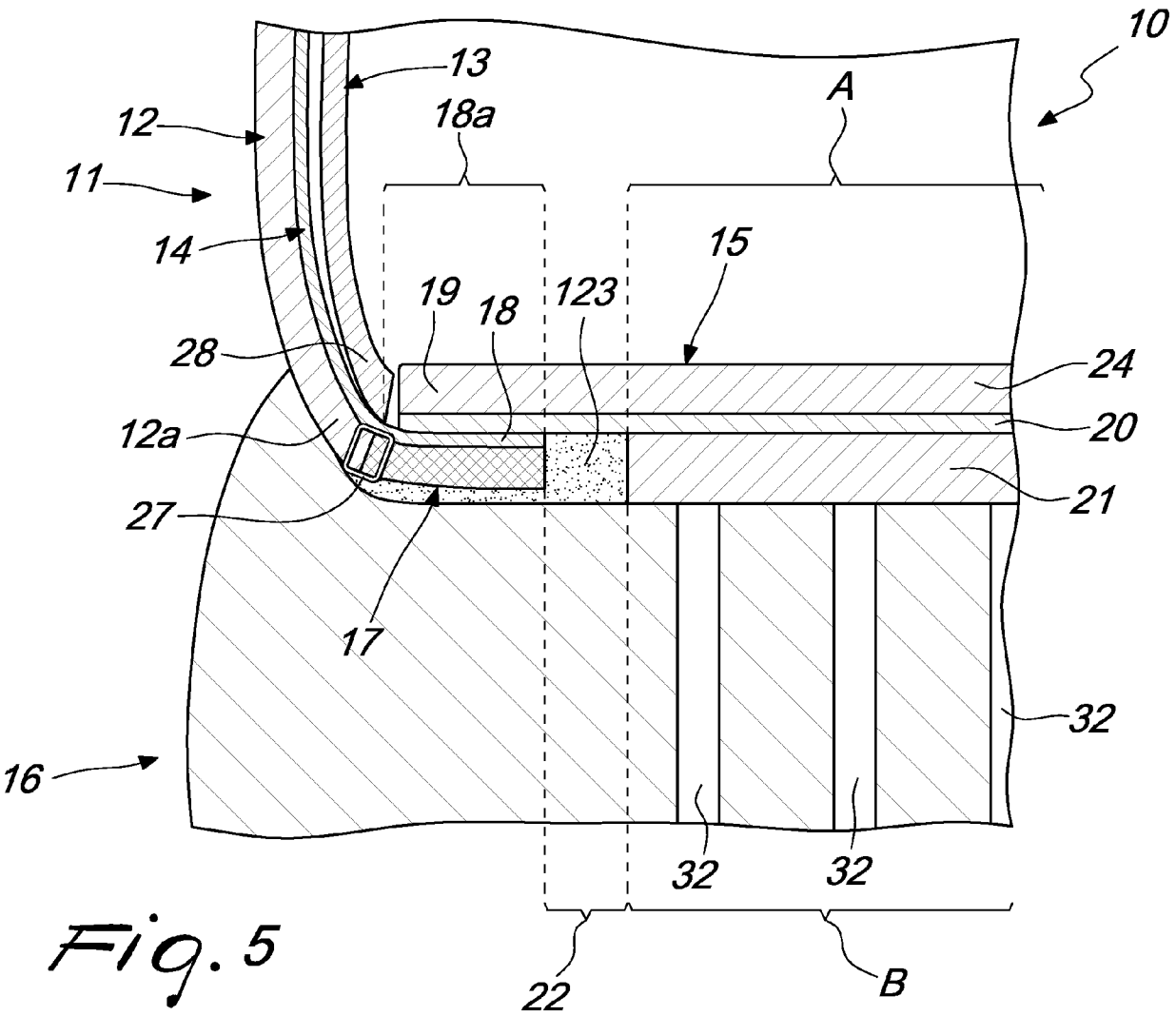

In a second method of embodiment of the invention, illustrated by way of non-limiting example in the accompanying FIGS. 4 and 5, the flap 28 of the lining 13 is joined to the edge 18 of the functional element of the upper 14, preferably by gluing at the edge of the last, so that the edge 18 is left uncovered, free from the flap 28, for a free portion 18*a* thereof whose width is comprised for example substantially between 10 mm and 15 mm.

Advantageously, the edge 18 and the sealing band 17 are folded back and glued under the rim 19 of the insole 15, according to the working method known as "AGO lasting", with a lasting operation conveniently without using tacks or staples, which might damage the functional element of the upper 14 and the lower functional element 20.

Such lasting operation is conveniently performed by means of a machine known as lasting machine, in which the lasting pincers have been flattened or have been deprived of the clamping teeth or millings, so as to avoid tearing the functional element of the upper 14.

The sealed coupling between the functional element of the upper 14 and the lower functional element 20 of the insole 15 occurs conveniently by using adhesive that is used in the lasting operations, such as of the thermoplastic, polyurethane or equivalent type and in any case capable of ensuring an effective seal.

Advantageously, an element for reinforcing the edge 18 of the functional element of the upper 14, not shown in the accompanying figures, is provided in order to prevent the lasting pincers from tearing it during the lasting operation.

Said reinforcement element advantageously comprises a waterproof thermoadhesive tape, which is preferably elastic and made of synthetic material, for example polyurethane, PU, such as for example the tape having a weight comprised substantial between 110 g/m$^2$ and 240 g/m$^2$, currently proposed by the company TecnoGI.

Figure 7:
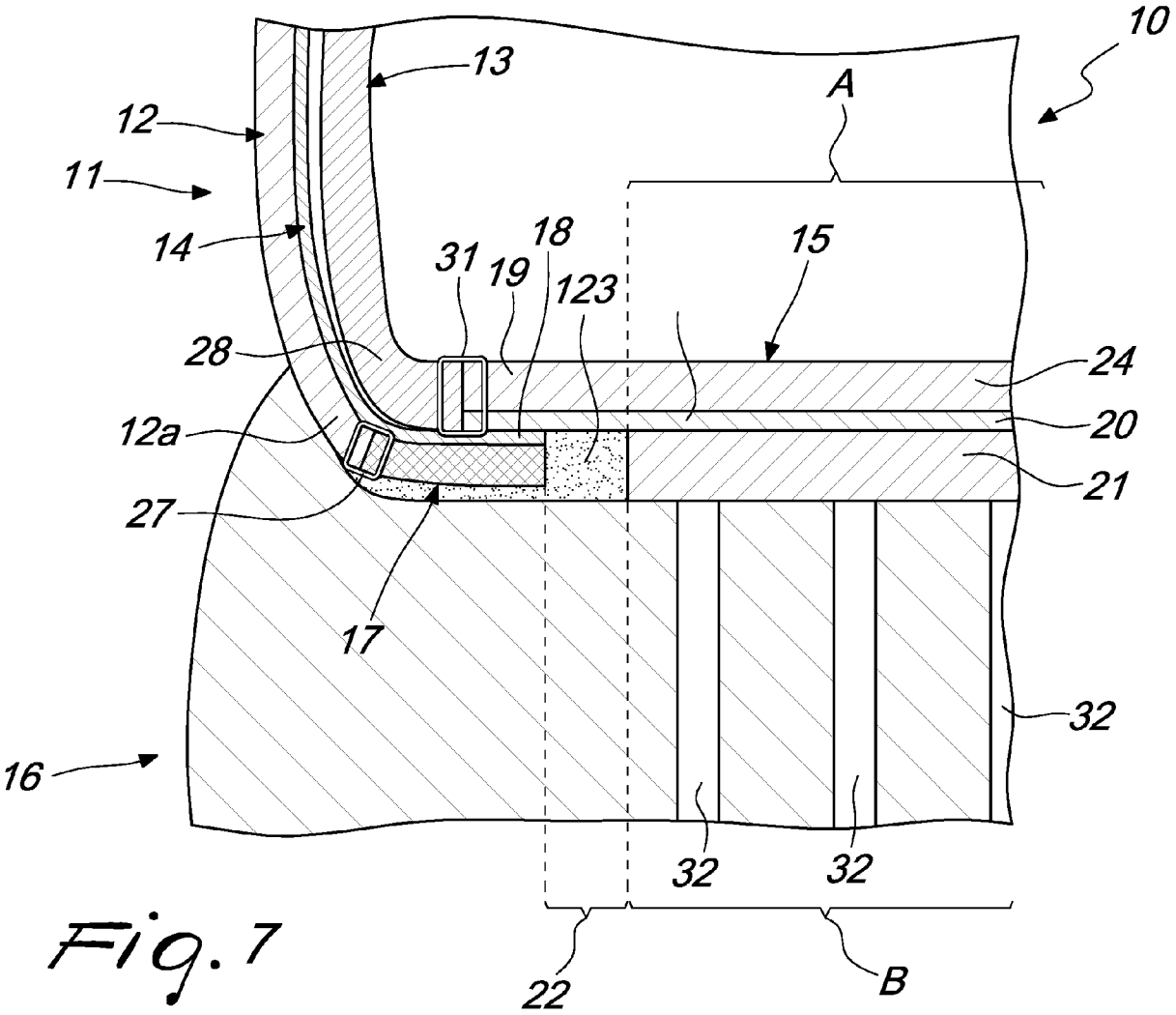

In a third method of embodiment of the invention, illustrated by way of non-limiting example in the accompanying FIGS. 6 and 7, the flap 28 of the lining 13 is joined to the rim 19 of the insole 15 preferably by means of a fourth seam 31, conveniently of the Strobel type or in a substantially equivalent manner of the type known as "zigzag".

The edge 18 and the sealing band 17 are folded back and glued under the rim 19 of the insole 15, according to the working method known as "AGO lasting".

The protective element 21 is conveniently made of a material that is resistant to hydrolysis and is vapor-permeable and selected among felt, nonwoven fabric and the like, treated so as to be water-repellent and conveniently having a thickness comprised substantially between 1 mm and 2 mm.

The protective element 21 advantageously has the role of protecting the lower functional element 20 against any foreign bodies that intrude in the holes 32, for example during use of the shoe 10.

As described in greater detail hereinafter, the protective element 21 further has some functionalities that substantially depend on the method for forming the bottom with sole 16 and on the method of its joining to the upper assembly 11 and the insole 15, and on the method for joining the upper assembly 11 to the insole 15.

In a first embodiment, illustrated by way of non-limiting example in FIGS. 1, 4 and 6, the bottom with sole 16 of a shoe 10 according to the invention conveniently is formed directly on the upper assembly 11 associated with the insole 15 by molding, monolithically, by injection or pouring of polymeric material, preferably selected among thermoplastic material, polyurethane (PU) and has through holes 32 that define its vapor permeation region B.

In the molding of the bottom with sole 16 on the upper assembly 11 associated with the insole 15, conveniently the mold is closed so that pins, adapted to form the holes 32, are at the protective element 21, which is adjacent to the insole 15, for example being glued thereto by spots of glue, so as to not compromise its vapor permeability.

In said first embodiment, a functionality of the protective element 21 advantageously consists in preventing the sealing material 23, during molding, from wetting the lower functional element 20 in the waterproof vapor permeation region A, in order to preserve its vapor permeability.

Moreover, an additional role of the protective element 21 consists in preventing, during molding, the infiltration of the sealing material 23 between said element and said pins, in order to keep open the holes 32 that said pins are adapted to form.

In said first embodiment, advantageously the sealing material 23 is the material that constitutes the bottom with sole 16, being molded onto the upper assembly 11 associated with the insole 15.

The sealing material 23 is injected or poured into said mold, conveniently so as to grip, so as to provide a waterproof seal, the lower functional element 20 at the band 22, and if the sealing band 17 is provided according to said first method of embodiment, i.e., is permeable to sealing material, then the sealing material 23 is injected or poured into the mold so as to grip, so as to provide a waterproof seal, also the edge 18 of the functional element of the upper 14, permeating the sealing band 17, otherwise if the sealing band 17 is provided according to said second method of embodiment, i.e., is waterproof, then the sealing material 23 is injected or poured into the mold so as to join also the sealing band 17 so as to provide a waterproof seal.

In particular, in said second method of embodiment of the sealing band 17, depending on the contingent requirements of embodiment of the invention, when a manufacturing method is selected according to which the sealing band 17 is already sealed to the edge 18 of the functional element of the upper 14, before the association of the bottom with the sole 16, then the sealing material 23 grips it so as to provide a waterproof seal, as an alternative when a manufacturing method is selected according to which the sealing band 17 is made of thermoactivatable polymeric material, then the sealing material 23 melts it, promoting its sealing adhesion to the edge 18 of the functional element of the upper 14, sealing itself simultaneously thereto, so as to define said mutual waterproof seal between the functional element of the upper 14 and the lower functional element 20.

In particular, if the upper assembly 11 is associated with the insole 15 as in said first embodiment of the invention, conveniently the sealing material 23 also seals the third seam 30.

When instead the upper assembly 11 is associated with the insole 15 as in said second or third embodiment of the invention, advantageously the sealing material 23 seals the rim 19 of the insole 15 to the edge 18, which is folded back and glued under the rim 19, by way of the sealing band 17.

With particular reference to said first embodiment, advantageously in the insole 15, at the band 22, there are holes having a diameter comprised substantially between 2 and 5 mm, which allow the passage of the sealing material 23, ensuring the monolithic grip of the bottom with sole 16 to the insole 15 associated with the upper assembly 11.

In this case, in fact, the sealing material 23 penetrates through said holes, filling them, until it reaches the foot insertion region, where it is stopped by the last of the mould on which the upper assembly 11 is fitted.

In constructive variations of said first embodiment, which are not described further or illustrated in the accompanying figures, said bottom with sole can have multiple parts, for example a mid-sole, made for example of polyurethane (PU) and a layer that acts as tread, for example made of rubber, and has through holes that define its vapor permeation region.

The material that forms said mid-sole, constituting said sealing material, is conveniently overmolded onto said upper assembly associated with said insole and onto said tread, which is conveniently arranged adjacent to said protective element, for example by being glued or overmolded.

With particular reference to FIGS. 2, 5 and 7, in a second and alternative embodiment of a shoe 10 according to the invention the sealing material is designated by the reference numeral 123 and comprises a sealing adhesive, which is spread onto the sealing band 17, onto the band 22 and onto their connecting region.

Said sealing adhesive conveniently is spread also, or as an alternative, on the bottom with sole 16 at its portion that is designed for joining to the sealing band 17, to the band 22 and to their connecting region.

Thus, the sealing material 123 conveniently seals the functional element of the upper 14 to the lower functional element 20 at its band 22.

In particular, if the sealing band 17 is provided so that it is permeable to the sealing material 123, the sealing material 123 conveniently grips, so as to provide a waterproof seal, the edge 18 of the functional element of the upper 14, permeating the sealing band 17 so as to define a mutual waterproof seal between the functional element of the upper 14 and the lower functional element 20.

When instead the sealing band 17 is provided waterproof and is made of waterproof polymeric material, which adheres intimately so as to provide a waterproof seal to the edge 18 of the functional element of the upper 14, the sealing material 123 conveniently defines, in cooperation with the sealing band 17, a mutual waterproof seal between the functional element of the upper 14 and the lower functional element 20.

In alternative embodiments of the invention, which are not described further herein or illustrated in the accompanying figures, said sealing material can be a sealant which is spread onto the sealing band 17, onto the band 22 and onto their connecting region.

Thus, once said lower functional element and said functional element of the upper have been sealed, at least one layer of adhesive is provided advantageously for the connection and sealing of said bottom with sole to said upper assembly joined to said insole.

Conveniently, the sealing material 123 is selected among silicone adhesives, thermoplastic adhesives, reactive polyurethane hot-melt adhesives, such as the adhesive currently known under the trade name IPATHERM S 14/176 manufactured by the company H.B. Fuller, or equivalents, or latex or polyurethane.

Conveniently, in said second embodiment, or in the case of gluing between the bottom with sole 16 and the upper assembly 11 joined to the insole 15, a further role of the protective element 21 consists in preventing, during gluing, the sealing material 123 from wetting the lower functional element 20 at the waterproof vapor permeation region A.

Moreover, another role of the protective element 21 conveniently consists in leveling the thickness of the sealing material 123 that is interposed between the bottom with sole 16 and the upper assembly 11 joined to the insole 15.

In the case of the second and third methods of embodiment of the invention, illustrated for example by way of non-limiting example in the accompanying FIGS. 5, 6 and 7, an additional role of the protective element 21 is to preserve the lower functional element 20 against possible tears by the foot of the lasting machine during the steps of the lasting of the upper assembly 11 with the insole 15.

In practice it has been found that the invention thus described achieves the intended aim and objects, by providing a shoe with waterproof upper and sole that overcomes the limitations of currently known shoes, allowing to have a structure that is simpler and allows to obtain an effectively waterproof shoe.

The joining of the rim of the insole and of the rim of the upper assembly formed by the sealing band joined to the edge of the functional element of the upper in fact prepares for effective grip, on the part of the sealing material, of the band of the lower functional element and of the edge of the functional element of the upper, in cooperation with the sealing band, so as to form between them a mutual waterproof seal.

A shoe according to the invention allows to avoid the stagnation of water inside its upper thanks to the fact that the functional element of the upper adheres thereto or is laminated thereto, so as to not provide between said element and the upper gaps where infiltrated water might be accommodated.

In particular, a shoe according to the invention, by avoiding the stagnation of water inside its upper, ensures that the user's foot remains warm and dry.

Moreover, again by avoiding the stagnation of water inside its upper, a shoe according to the invention allows effective permeation of water vapor from the foot insertion region toward the outside and is furthermore lightweight and, if wet, easy and quick to dry.

Moreover, a shoe according to the invention is easy to seal in order to prevent infiltrations of water into it, thanks to the ease with which a sealing material mutually seals the band of the lower functional element and the edge of the functional element of the upper, reaching it through the sealing band that supports it, when said band is provided permeable, or in cooperation therewith when it is provided waterproof.

Moreover, a shoe according to the invention is effectively and durably waterproof while being vapor-permeable both through the upper assembly, thanks to the functional element of the upper that is a portion thereof, and through its bottom, which is vapor-permeable thanks to the provision of the lower functional element.

A shoe according to the invention is furthermore structurally simple and comfortable to wear and use.

The invention thus conceived is susceptible of numerous modifications and variations, all of which are within the scope of the appended claims; all the details may further be replaced with other technically equivalent elements.

In practice, the materials used, so long as they are compatible with the specific use, as well as the contingent shapes and dimensions, may be any according to requirements and to the state of the art.

The disclosures in Italian Patent Application No. PD2010A000037 from which this application claims priority are incorporated herein by reference.

The invention claimed is:

1. A shoe with a waterproof and vapor-permeable upper and sole, comprising:

an upper assembly which at least comprises, in a stratified manner, the vapor-permeable or perforated outer upper, a vapor-permeable inner lining, and a functional element of the upper assembly which is permeable to water vapor and impermeable to water in the liquid state, the functional element of the upper assembly being disposed between said upper and said vapor-permeable inner lining;

an insole which is joined to said upper assembly and includes at least one waterproof vapor permeation region;

a bottom with the sole which includes a vapor permeation region provided at said at least one waterproof vapor permeation region, to allow dissipation of water vapor that arrives from said insole;

wherein said functional element of the upper assembly is firmly joined to said upper so as to be fully adherent to said upper, said upper ending toward said insole with a sealing band, which is covered at least partly by an edge of said functional element of the upper assembly, said sealing band and said edge being associated with a perimetric rim of said insole;

said insole selectively comprising or being joined to at least one lower functional element which is permeable to water vapor and impermeable to water in the liquid state;

said waterproof vapor permeation region being formed substantially, on said at least one lower functional element, by at least one vapor-permeable protective element, which is arranged so as to be interposed between said at least one lower functional element and said bottom with the sole, said lower functional element including at least one band which is perimetric to said waterproof vapor permeation region, not covered by said protective element;

a mutual waterproof seal being provided between the edge of said functional element of the upper assembly, at said sealing band, and the band of said at least one lower functional element at said band.

2. The shoe according to claim 1, wherein said insole comprises at least one structural layer, which is vapor-permeable or perforated and is joined to said lower functional element and is directed, with respect to said element, toward the inside of said shoe.

3. The shoe according to claim 1, wherein a width of said sealing band is substantially between 8 mm and 12 mm.

4. The shoe according to claim 1, wherein said sealing band is permeable to sealing material, said mutual waterproof seal being provided by said sealing material, which form a waterproof seal at said band and permeates through said sealing band so as to waterproof sealingly grip the edge of said functional element of the upper assembly.

5. The shoe according to claim 4, wherein said sealing band is made of waterproof polymeric material, said mutual waterproof seal being provided by cooperation of said sealing band with said sealing material, said sealing band adhering intimately so as to provide a waterproof seal to said edge and said sealing material gripping so as to form a waterproof seal said sealing band and said lower functional element, at said band.

6. The shoe according to claim 4, wherein said sealing material comprises a material that constitutes at least part of said bottom with the sole, when said at least part of said bottom with the sole is overmolded on said upper assembly joined to said insole.

7. The shoe according to claim 4, wherein said sealing material comprises a sealing adhesive that is spread on said sealing band, on said band and on connection regions of said sealing band and said band.

8. The shoe according to claim 4, wherein said sealing material comprises a sealing adhesive, which is spread on said bottom with the sole, at a part of said sole designed for joining to said sealing band, to said band and to connection regions of said sealing band and said band.

9. The shoe according to claim 1, wherein said sealing band is tape-shaped and has a structure selected from a group consisting of a structure with transverse fibers, a web-like structure, a knitted fabric structure, a woven fabric structure, and a three-dimensional fabric structure.

10. The shoe according to claim 1, wherein said sealing band is tape-shaped and is deformed elastically in a differential manner along its two longitudinal sides, a first longitudinal side of said longitudinal sides being joined to an edge of the body of said upper and a second longitudinal side of said longitudinal sides being joined to said rim of said insole, to compensate for a different arc length, subtended to a same angle, assumed correspondingly by said edge of the body and by said rim, that said sealing band joins.

11. The shoe according to claim 10, wherein said sealing band comprises:

a central portion, which includes a structure selected from a group consisting of a structure with transverse fibers, a web-like structure, a knitted fabric structure, a structure with woven fabric, and a structure with three-dimensional fabric, and two elastic bands which are lateral to said central portion and with which the two elastic bands form a single body, forming said longitudinal sides.

12. The shoe according to claim 1, wherein said band as a width substantially between 5 and 8 mm.

13. The shoe according to claim 1, wherein said functional element of the upper and said at least one lower functional element are made of waterproof and vapor-permeable polymeric material selected from a group consisting of expanded polytetrafluoroethylene, and polyurethane.

14. The shoe according to claim 1, wherein said at least one protective element is made of a material that is resistant to hydrolysis and is vapor-permeable and is selected from a group consisting of felt treated to be water repellent, and a nonwoven fabric treated to be water-repellent.

15. The shoe according to claim 1, wherein a flap of said lining is joined to said edge so that said edge is left exposed, free from said flap, with a free portion thereof, said edge and said sealing band being joined, folded back and glued below said rim of said insole.

16. The shoe according to claim 15, wherein said free portion has a width substantially between 10 and 1.5 mm.

17. The shoe according to claim 1, wherein a flap of said lining is joined to said rim by means of a stitched seam, said edge and said sealing band being joined, folded back and glued below said rim.

18. The shoe according to claim 17, wherein said stitched seam is selected from a group consisting of a Strobel seam, and zigzag seam.

19. The shoe according to claim 1, wherein the flap of said lining, said edge and said sealing band are associated with said rim by a stitched seam.

20. The shoe according to claim 19, wherein said stitched seam is from a group consisting of a Strobel seam and pinching sewing seam.

* * * * *